US006254419B1

(12) United States Patent
Hirschmann et al.

(10) Patent No.: US 6,254,419 B1
(45) Date of Patent: Jul. 3, 2001

(54) ELECTRICAL CONNECTOR

(75) Inventors: Michael Hirschmann, Güglingen; Claus Dullin, Bad Rappenau, both of (DE)

(73) Assignee: Amphenol-Tuchel Electronics GmbH (DE)

( * ) Notice: Subject to any disclaimer, the term of this patent is extended or adjusted under 35 U.S.C. 154(b) by 0 days.

(21) Appl. No.: 09/383,081

(22) Filed: Aug. 25, 1999

(30) Foreign Application Priority Data

Oct. 2, 1998 (DE) ..... 198 45 351

(51) Int. Cl.[7] ..... H01R 13/64
(52) U.S. Cl. ..... 439/372; 439/347
(58) Field of Search ..... 439/372, 352, 439/188, 354, 357, 345, 368, 370, 489, 157, 347

(56) References Cited

U.S. PATENT DOCUMENTS

| | | | | |
|---|---|---|---|---|
| 5,591,041 | * | 1/1997 | Cecil, Jr. et al. | 439/352 |
| 5,616,045 | | 4/1997 | Gauker | 439/352 |
| 5,647,757 | * | 7/1997 | Chrysostomou | 439/352 |
| 5,853,298 | * | 12/1998 | Pacher | 439/352 |

FOREIGN PATENT DOCUMENTS

| | | | |
|---|---|---|---|
| 195 13 358 | 8/1996 | (DE) | H01R/13/639 |
| 195 11 410 | 10/1996 | (DE) | H01R/13/639 |
| 295 21 491 | 9/1997 | (DE) | H01R/13/639 |
| 196 17 820 | 11/1997 | (DE) | H01R/13/639 |

* cited by examiner

*Primary Examiner*—Gary F. Paumen
*Assistant Examiner*—Ross Gushi
(74) *Attorney, Agent, or Firm*—Blank Rome Comisky & McCauley, LLP

(57) ABSTRACT

The invention refers to an electrical connector, in particular for connecting a receptacle (squib) to an electrical control unit for restraint systems in motor vehicles.

14 Claims, 2 Drawing Sheets

ELECTRICAL CONNECTOR

BACKGROUND OF THE INVENTION

1. Field of the Invention

Figure 1:
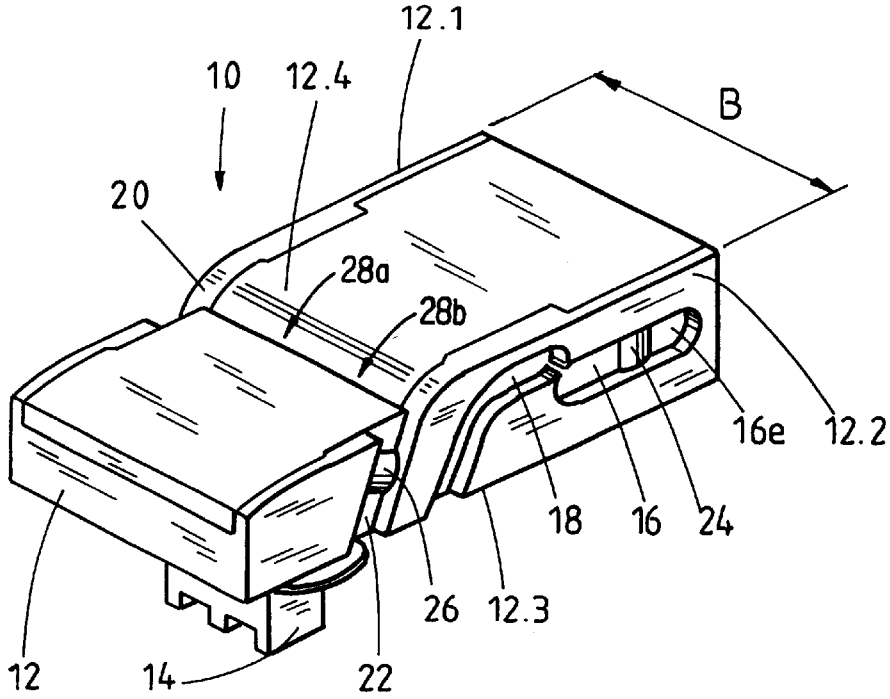

The invention refers to an electrical connector, in particular for connecting a receptacle (squib) to an electrical control unit for restraint systems in motor vehicles, for example air bags.

2. Description of Related Art

Such a connector is known from DE 295 21 491 U1. It comprises a housing for receiving electrical cables as well as contact springs connected thereto, the contact springs serving for receiving contact pins of the associated receptacle. Furthermore, catching means for securing the housing to the receptacle as well as a locking member are provided. The locking member serves for securing the catching means of the housing and the receptacle against an accidental detachment. The locking member is attached to the housing via flexible tongues and, after the tongues having been bent, is guided through a corresponding opening of the housing into the locking position.

In principle, the connector mentioned above has proved its worth; but because of the extremely small structure of the connector and the flexible tongues along which the locking member is guided, mounting of the locking member requires an appropriate experience, especially if it is to be mounted with one hand only.

This is true especially if the plugging part extends perpendicularly to a base body of the housing, as in DE 295 21 491 U1, and not coaxially with that, as is known from DE 195 13 358 C1.

SUMMARY OF THE INVENTION

Accordingly, it is an object of the invention to provide a connector of the type mentioned above, the plugging part of which may be mounted easily to a plugging part of an associated receptacle, including the associated secondary locking by means of the said locking member.

The basic idea is not to hinge the locking member to the base body of the housing via flexible tongues but to guide it along the base body of the housing in a defined manner, that is between a condition in which the locking member is "open" (condition of delivery) and a condition in which the locking member serves its function as a secondary locking (that is in the condition of contact of the housing of the connector with the associated receptacle).

That definite guidance can be obtained with the aid of a locking member having an L-like shape. Here, a first portion of the locking member especially serves for the guidance on the base body of the housing, whereas a second portion projecting perpendicularly therefrom serves for the secondary locking function.

Accordingly, the invention in its most general embodiment refers to an electrical connector, in particular for connecting a receptacle to an electrical control unit for restraint systems in motor vehicles, having the following features:

- a housing having a base body and a plugging part projecting perpendicularly from the base body and facing the receptacle,
- contact springs are arranged in the plugging part of the housing,
- first catching means are formed beside the plugging part for catching corresponding second catching means of the receptacle having contact pins,

- an L-shaped locking member for securing the catching means of the housing and the receptacle,
- a first portion of the locking member being U-shaped with legs extending in parallel and the legs as well as the base body of the housing having corresponding guiding means for guiding the first portion of the locking member in a longitudinal direction of the base body of the housing, and
- a second portion of the locking member being U-shaped as well, the parallel legs of which secure the catching means of the housing and the receptacle against an accidental detachment, after the first portion having been moved in the longitudinal direction of the base body of the housing and the legs having been guided through corresponding openings in the base body of the housing.

For example, the guiding means may be formed by corresponding grooves and pegs (pins) in or on the legs of the first portion of the locking member or in or on side faces of the base body of the housing, as is described by claims 2 and 3.

According to claim 2, guidance of the locking member in a defined manner along the base body of the housing is effected along grooves on the housing, the pegs on the first portion of the locking member being guided along those grooves.

The grooves may extend from the upper surface of the base body of the housing into the base body. Because of the said small size of such connectors, for reasons of space it presents itself to form the grooves in the side faces of the base body so that the legs of the first portion of the locking member reach laterally beyond the base body.

The embodiment according to claim 3 is different from the configuration according to claim 2 by inversion of the guiding means. Correspondingly, that is also true for alternative configurations of the further embodiments described below and results in the following from subclaims 4, 6, 9, 10, 14 and 15.

The movement of the locking member to the position of the secondary locking is facilitated by the grooves in the base body of the housing having an arcuate shape and extending towards the plugging part, at least at their end adjacent the plugging part. A specific arcuate guideway for the locking member is created thereby in order to guide it to the locking position by turning.

Here, the grooves may have a involute-like shape.

As shown in the description of the figures below, it is also possible to provide several grooves in the region of each leg of the first portion of the locking member and to form the legs having several pegs, correspondingly. In turning the locking member a definitely given guideway is obtained thereby.

In order to prevent the pegs sliding accidentally out of the grooves, an embodiment provides to arrange at least one end of the grooves at a distance from the free end of the base body of the housing and preferably at a distance from the end of the base body opposite the plugging part. Without problems, the other end of the groove may be "open", because the movement of the locking member is limited by the connecting leg between the parallel legs of the first portion, when it hits the housing body.

According to an embodiment the grooves are provided with at least one elevation along their basis.

If this elevation is disposed at a distance from the "closed" end of the grooves, for example, the connector may be premounted at the factory (condition of delivery) in such a manner that the associated pins close to the end of the locking member are situated in the region between the elevations and the "closed" ends of the groove and thus prevent that the locking member "slips" to the locking position. However, the elevations have such a low height that in the final assembly (connection to the associated receptacle) a fitter may move the pins past the elevations with an appropriate pressure onto the locking member and guide them along the further groove portions to the secondary locking position. Second elevations at the opposite end of each guideway for the pins correspondingly serve for securing the locking member in its plugged-in position, as soon as the pins have been guided over those second elevations towards the plugging part.

A development of the said embodiments provides to dispose at least three pegs on each leg of the first portion of the locking member, one peg being guided on an arcuately shaped surface portion of the first portion, respectively. Accordingly, that peg does not slide along said grooves but slides virtually as a counterbearing on a corresponding surface portion of the base body of the housing. In that region as well, two or more of the said elevations may be disposed.

As known from DE 295 21 491 U1, the connecting leg extending between the legs of the second portion of the locking member may be split in the longitudinal direction. Correspondingly, two openings are to be provided in the housing, through which the legs may be guided.

In the configuration according to the invention, the second portion of the locking member may also be used to remove a shorting bar in the region of the contact pins of the receptacle, when the locking member has reached its maximum locking position. The corresponding structural configuration is known from DE 295 21 491 U1.

Especially for that application but also generally, the grooves in the base body of the housing may be formed at their end facing the plugging part in such a manner that the second portion of the locking member extends substantially in parallel with the plugging part, at least at the end of its guideway towards the receptacle. By this means, the secondary locking on the one hand and the removal of the shorting bar on the other hand is optimized.

Further characteristics of the invention follow from the features of the subclaims as well as the other application documents.

In the following, the invention is explained in more detail with an embodiment. Here, the figures show—each in schematic representation:

BRIEF DESCRIPTION OF THE FIGURES OF DRAWINGS

Figure 2:
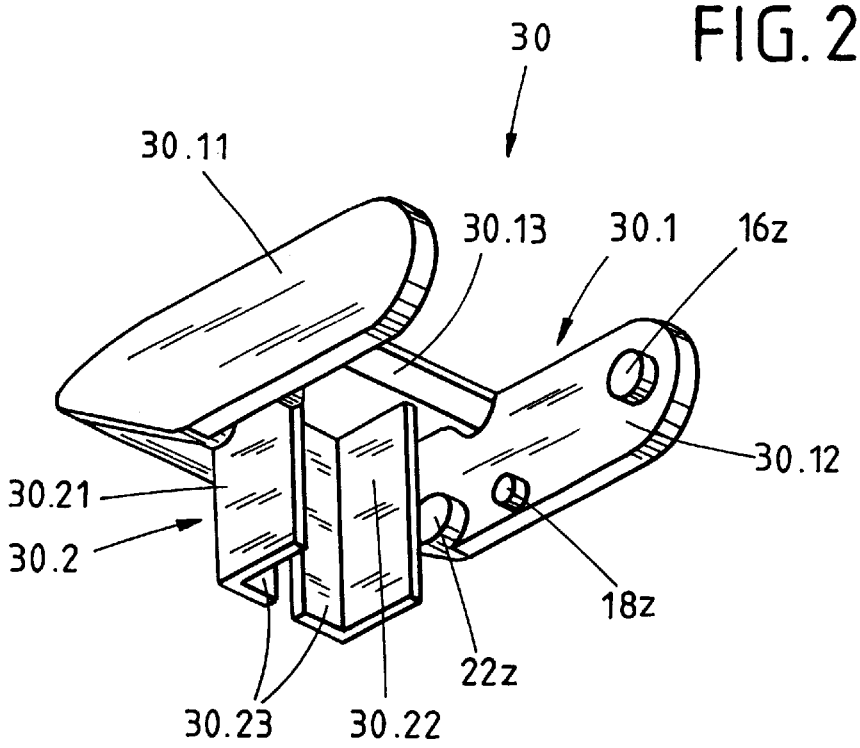
Figure 3:
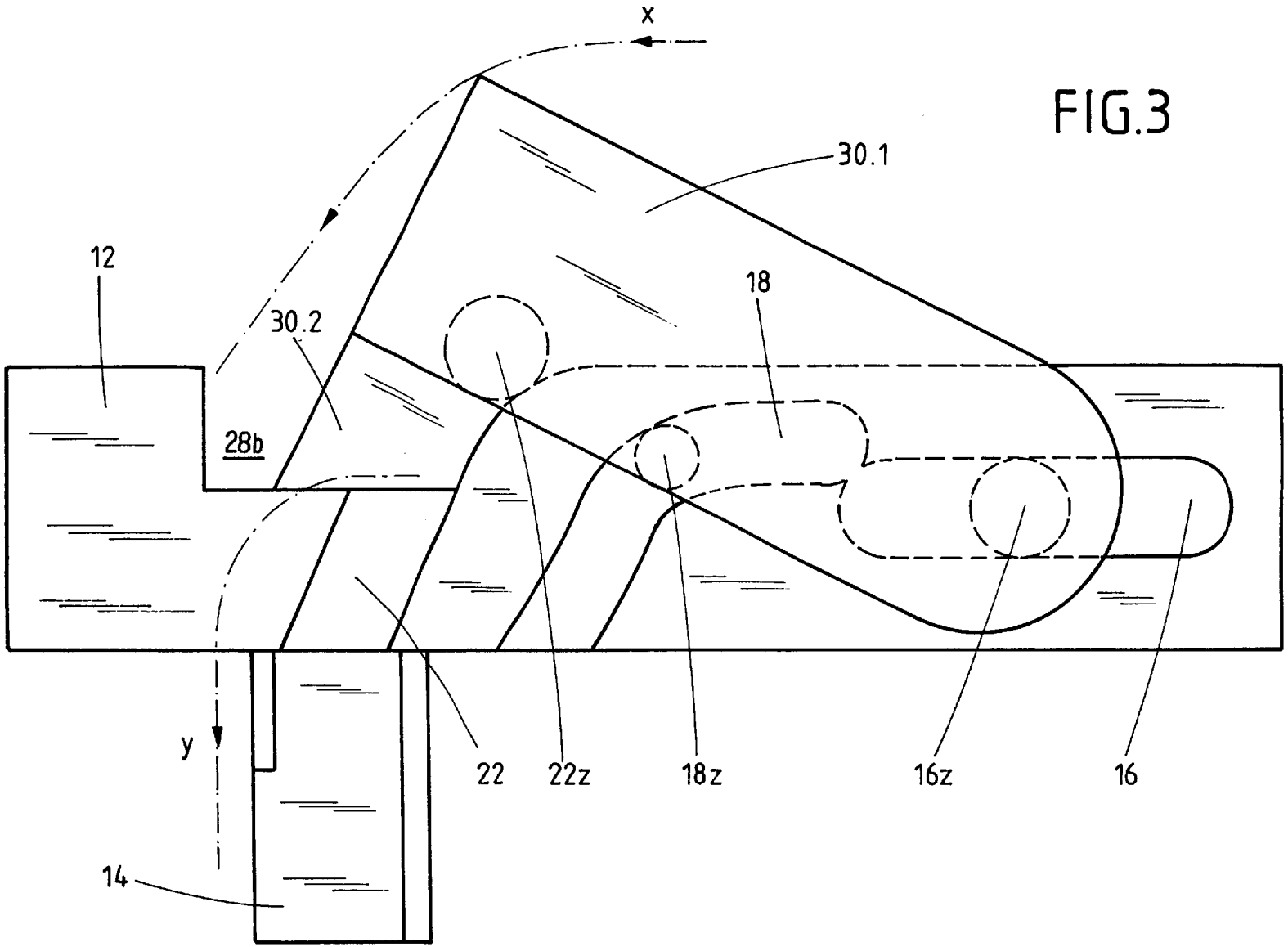

FIG. 1 a perspective view of a housing of a connector,

FIG. 2 a perspective view of an associated locking member,

FIG. 3 a schematic diagram showing the relative movement of the locking member with respect to the housing of the connector.

DETAILED DESCRIPTION OF THE PREFERRED EMBODIMENT

In FIG. 1, the reference number 10 indicates a housing of a connector according to the invention. The housing 10 comprises a base body 12 of the housing and a plugging part 14 projecting prependicularly therefrom in a downward direction, in which contact springs (not illustrated) are disposed in the usual manner.

The base body 12 has substantially the shape of a right parallelepiped with side faces 12.1, 12.2.

On each of the side faces 12.1, 12.2 a first groove 16 extends substantially in parallel with the basis 12.3 of the base body 12 at a distance from the right end in FIG. 1.

Towards the plugging part 14, a second groove 18 adjoins the groove 16, extending from a first end (above the groove 16) arcuately to the basis 12.3 of the base body 12.

In parallel with the extension of the groove 18 the base body 12 is former with an arcuate surface portion 20 on both sides, another groove 22 being formed thereby, which extends substantially in parallel with the groove 18.

In that region of the base body 12 the housing 10 is formed with openings (28*a* and 28*b*), the function of which will be described in more detail below.

As shown in FIG. 1, in the region of the groove 16 a cam 24 is disposed at a distance from the right end of the groove 16, which rises outwardly from a basis of the groove 16 and has an arcuate surface.

In the region of the groove 22 too, an analogous cam 26 is disposed at a distance above the basis 12.3 on both sides of the base body 12.

The grooves 16, 18, 22 described above serve for receiving and guiding a locking member 30, as illustrated in FIG. 2.

The locking member is L-shaped. A first portion 30.1 is U-shaped, as well as a second portion 30.2 extending perpendicularly thereto.

The first portion 30.1 comprises two legs 30.11, 30.12 extending in parallel with each other and a leg 30.13 connecting the legs 30.11, 30.12 in the region of the second portion 30.2, which extends above the second portion 30.2.

The distance between the legs 30.11, 30.12 is slightly larger than the width B of the base body 12.

On the inside, three pegs 16*z*, 18*z* and 22*z* project perpendicularly from each leg 30.11, 30.12. The diameter of each peg 16*z*, 18*z*, 22*z* is slightly smaller than the width of the associated groove 16, 18 and 22, respectively.

The second portion 30.2 has a U-shaped cross section as well, the connecting leg 30.23 being slit in the longitudinal direction and the parallel side legs 30.21, 30.22 extending in parallel with the legs 30.11, 30.12.

In correspondence with the shape of the second portion 30.2 of the locking member 30, each of the said through openings 28*a* and 28*b* in the housing 10 is L-shaped.

In premounting, the locking member 30 is placed upon the base body 12, that is in such a manner that the pegs 16*z* are positioned in the grooves 16, the pegs 18*z* are positioned in the grooves 18 and the pegs 22*z* are positioned in the grooves 22, that is at the beginning in such a manner that the pegs 16*z* are situated behind the elevations 24 and before the corresponding end 16*e* of the groove 16.

For the other pegs 18*z*, 22*z* and the locking member 30, a position with respect to the base body 12 results, in which the second portion 30.2 of the locking member 30 does not (yet) project downwardly beyond the base body 12.

After the plugging part 14 of the housing 10 having been put onto an associated plugging part of a receptacle, the locking member is first pressed "forwardly", the pegs 16*z*, 18*z* and 22*z* passing along the associated grooves 16, 18, 22 (direction of arrow x) and occupying the intermediate position illustrated in FIG. 3, for example. Afterwards, the pegs 16*z*, 18*z* and 22*z* cause the locking member 30 to descend (direction of arrow y) towards the plugging part 14 and are guided further along the associated grooves 16, 18, 22 until the connecting leg 30.13 hits the surface 12.4 of the base body 12. Now, the locking member 30 has reached its end position (secondary locking position) and the second portion 30.2 has removed said shorting bar in the region of the contact pins of the receptacle. Securing the locking member 30 in that position is effected by the pegs 22*z* being now situated behind the elevations 26.

At their end on the right hand in the figures) opposite the plugging part 14 the grooves 16, 18, 22 may extend again downwardly (towards the plugging part 14) in an arcuate manner to guide the locking member 30 to a position (unlocking position) in which it is turned by at least 90° with respect to the upper surface 12.4 of the base body 12. In that, the parallel legs 30.11, 30.12 are guided downwardly under the lower surface 12.3 of the base body 12 of the housing. At the same time the protecting part of the locking member 30 presses against a corresponding surface of the receptacle, the plugging part 14 being released from the position of contact with the receptacle thereby.

What is claimed is:

1. An electrical connector, in particular for connecting a receptacle to an electrical control unit for restraint systems in motor vehicles, comprising:

a housing having a base body extending in a longitudinal direction and a plugging part projecting perpendicularly from the base body and facing the receptacle, a locking member for securing the housing and the receptacle together, wherein a first portion of the locking member is U-shaped with legs extending in parallel and the legs as well as the base body of the housing have corresponding guiding means for guiding the first portion of the locking member in the longitudinal direction of the base body of the housing, and a second portion of the locking member is U-shaped, the parallel legs of which secure the housing and the receptacle against an accidental detachment, after the first portion having been moved in the longitudinal direction of the base body of the housing and the legs of the second portion having been guided through corresponding openings in the base body of the housing, the first and second portions together forming in cross-section an L-shaped configuration;

wherein each of the legs of the first portion of the locking member extending in parallel, has at least one peg projecting perpendicularly and the pegs can be moved along corresponding grooves extending in the base body of the housing in the longitudinal direction of the base body of the housing.

2. The connector according to claim 1, wherein at least one groove bends.

3. The connector according to claim 1, wherein the at least one groove in the base body of the housing bends and extends towards the plugging part.

4. The connector according to claim 1, wherein the legs of the first portion of the locking member are arranged laterally beyond the base body of the housing.

5. The connector according to claim 1, wherein the legs of the first portion of the locking member are arranged laterally beyond the base body of the housing and the grooves are formed in corresponding side faces of the base body.

6. The connector according to claim 1, wherein one end of the grooves is positioned at a distance from a rearward end of the base body of the housing opposite the plugging part.

7. The connector according to claim 1, wherein each of the grooves has at least one cam disposed therein.

8. The connector according to claim 1, having three pegs on each leg of the first portion of the locking member, at least one peg being guided on an arcuate surface region of the base body, respectively.

9. The connector according to claim 1, wherein a connecting leg extending between the legs of the second portion of the locking member is split in the longitudinal direction.

10. The connector according to claim 1, wherein the grooves are formed in such a manner that the second portion of the locking member extends substantially in parallel with the plugging part when the locking member is in a forward position.

11. The connector according to claim 1, wherein the grooves are formed in such a manner that the first portion of the locking member projects from the receptacle perpendicularly with respect to the base body of the housing when the locking member releases the plugging part from the receptacle.

12. An electrical connector adapted for connection to a receptacle, comprising:

a housing member having an upper surface extending longitudinally along and laterally from a longitudinal axis and having a forward portion and rearward portion connected to the forward portion in a manner to form at least one opening therebetween and a plugging part projecting perpendicularly relative to the upper surface, the forward portion having a pair of corresponding forward lateral sidewalls and the rearward portion having a pair of corresponding rearward lateral sidewalls extending perpendicularly relative to the upper surface, each rearward sidewall having a first groove, a second groove and a third groove, the first groove positioned rearwardly in the rearward portion and extending into and longitudinally along the rearward sidewall parallel with the longitudinal axis, the second groove positioned forwardly of the first groove and extending into the rearward sidewall and having a rearward linear grooved segment disposed between the first groove and the upper surface and extending parallel with the first groove, a forward linear grooved segment and a bent grooved segment connecting the rearward and forward grooved segments together in a manner that the forward grooved segment extends away from the upper surface relative to the bent grooved segment, the third groove formed between adjacent ones of the forward and rearward lateral sidewalls and extending parallel with the forward linear grooved segment of the second groove; and a locking member having a pair of leg elements extending longitudinally and parallel with one another and spaced apart a distance sufficient to receive the housing member therebetween, a transverse leg extending between and interconnecting the pair of leg elements and a leg assembly connected to and extending perpendicularly from the transverse leg, each leg element including a first peg, a second peg and a third peg with each peg projecting inwardly toward the leg assembly and oriented thereon such that, upon connecting the housing member and the locking member together, respective ones of the first pegs are slidably received in the first grooves for linear movement therein, respective ones of the second pegs are slidably received in the second grooves for linear and curved movement therein and respective ones of the third pegs are slidable along the upper surface and slidably received with the third grooves whereby advancing the locking member forwardly relative to the housing member from a rearward position to a forward position, the leg assembly is received through the at least one opening to partially shield the plugging part.

13. A connector according to claim 12, further comprising at least one first cam disposed generally rearwardly in the first groove, the at least one first cam operative in conjunction with one of the first pegs to releasably retain the locking member in the rearward position.

14. A connector according to claim 13, further comprising at least a second cam disposed within the third groove, the at least one second cam operative in conjunction with one of the third pegs to releasably retain the locking member in one of the forward position and an intermediate position disposed between the rearward position and the forward position.

* * * * *